US007798155B2

(12) United States Patent
Schweers et al.

(10) Patent No.: US 7,798,155 B2
(45) Date of Patent: Sep. 21, 2010

(54) HEADWEAR WITH INTERWOVEN GRIPPING FIBERS

(75) Inventors: Catherine Schweers, Atlanta, GA (US); Sarah Kraft, Atlanta, GA (US); Michael Defenbaugh, Marietta, GA (US); Stan Chudzik, Marietta, GA (US); P. Chiu Lau, China (CN)

(73) Assignee: Goody Products, Inc., Atlanta, GA (US)

( * ) Notice: Subject to any disclaimer, the term of this patent is extended or adjusted under 35 U.S.C. 154(b) by 739 days.

(21) Appl. No.: 11/622,381

(22) Filed: Jan. 11, 2007

(65) Prior Publication Data

US 2010/0017942 A9 Jan. 28, 2010

Related U.S. Application Data

(63) Continuation-in-part of application No. 11/272,996, filed on Nov. 14, 2005, now Pat. No. 7,305,996.

(60) Provisional application No. 60/628,148, filed on Nov. 16, 2004, provisional application No. 60/820,845, filed on Jul. 31, 2006.

(51) Int. Cl.
*A45D 8/00* (2006.01)

(52) U.S. Cl. ..... 132/273

(58) Field of Classification Search ..... 132/273, 132/274, 275, 57.1; 2/171, 174; D28/41
See application file for complete search history.

(56) References Cited

U.S. PATENT DOCUMENTS

| | | | | |
|---|---|---|---|---|
| 1,066,759 | A | 7/1913 | Schloss | |
| 2,030,610 | A | 2/1936 | Randall | |
| 3,000,119 | A | 9/1961 | Altman | |
| 3,778,845 | A | 12/1973 | Miller | 2/236 |
| 4,513,063 | A | 4/1985 | Hashi et al. | |
| 5,375,266 | A | 12/1994 | Crisco | |
| 5,727,574 | A | 3/1998 | Frye | |
| 5,758,671 | A | 6/1998 | Thim | |
| 5,787,904 | A | 8/1998 | Michaud | |

(Continued)

FOREIGN PATENT DOCUMENTS

| | | | |
|---|---|---|---|
| CN | 2322424 | Y | 11/1999 |

(Continued)

OTHER PUBLICATIONS

International Searching Authority, Written Opinion of the International Searching Authority, 6 pages, date unknown.

(Continued)

*Primary Examiner*—Cris L Rodriguez
*Assistant Examiner*—Rachel R Steitz
(74) *Attorney, Agent, or Firm*—Gardner Groff Greenwald & Villanueva, PC

(57) ABSTRACT

The present disclosure is generally directed to headwear and, more particularly, to headwear, including hats, visors, head wraps, head ties, bandanas and the like, that include interwoven gripping fibers, such as rubber threads or other materials having increased gripping or frictional forces beyond that of the materials from which the headwear are typically fabricated, integrated into the headwear and positioned to engage the skin and/or hair of the wearer to improve the retention of the headwear when worn during physical activities.

19 Claims, 6 Drawing Sheets

U.S. PATENT DOCUMENTS

| | | | | |
|---|---|---|---|---|
| 5,806,535 | A * | 9/1998 | Becker | 132/54 |
| 5,920,909 | A | 7/1999 | Ellsworth et al. | |
| 6,000,408 | A | 12/1999 | Maturaporn | |
| 6,079,236 | A | 6/2000 | Ives et al. | |
| 6,499,144 | B1 | 12/2002 | Yan | 2/181.2 |
| 6,516,637 | B1 | 2/2003 | Fancher et al. | |
| 6,567,991 | B1 | 5/2003 | Holslag et al. | 2/181.4 |
| 6,701,532 | B1 | 3/2004 | Glassberg et al. | |
| 6,711,749 | B2 | 3/2004 | White et al. | |
| 6,895,601 | B2 | 5/2005 | Park | 2/181 |
| 7,305,996 | B2 | 12/2007 | Kraft et al. | |
| 2004/0149306 | A1 | 8/2004 | Rogers | |
| 2006/0085891 | A1 * | 4/2006 | Larkin et al. | 2/171 |
| 2006/0168785 | A1 | 8/2006 | Kraft et al. | |
| 2007/0131238 | A1 | 6/2007 | Chudzik et al. | |

FOREIGN PATENT DOCUMENTS

| | | |
|---|---|---|
| CN | 200420095683.5 | 11/2004 |
| CN | 200420095684.X | 11/2004 |
| DE | 2041765 | 3/1971 |
| GB | 314707 | 8/1928 |
| GB | 814886 | 6/1954 |

OTHER PUBLICATIONS

International Search Authority, International Search Report, 5 pages, Mar. 17, 2006.

First Office Action, Mar. 31, 2010, State Intellectual Property Office, P. R. China, 6 pages.

* cited by examiner

HEADWEAR WITH INTERWOVEN GRIPPING FIBERS

CROSS-REFERENCE TO RELATED APPLICATION

This application is a continuation-in-part of U.S. patent application Ser. No. 11/272,996 filed Nov. 14, 2005 (now U.S. Pat. No. 7,305,996 issued Dec. 11, 2007), which claims the priority benefit of U.S. Provisional Patent Application Ser. No. 60/628,148 filed Nov. 16, 2004.

REFERENCE TO RELATED APPLICATION

This application claims priority from Provisional Application Ser. No. 60/820,845, filed on Jul. 31, 2006, which is expressly incorporated by reference herein.

FIELD OF THE DISCLOSURE

The present disclosure is generally directed to headwear and, more particularly, to headwear, including hats, visors, head wraps, head ties, bandanas and the like, that include interwoven gripping fibers, such as rubber threads or other materials having increased gripping or frictional forces beyond that of the materials from which the headwear are typically fabricated, integrated into the headwear and positioned to engage the skin and/or hair of the wearer to improve the retention of the headwear when worn during physical activities.

BACKGROUND OF THE DISCLOSURE

Hats, including baseball caps, bucket hats, visors and beach hats, tend to slip and fall off the wearers' heads during physical activities such as jogging, exercising, participating in other sporting activities and the like. Similarly, other types of headwear and head coverings, such as head wraps, head bands, bandanas, head ties and the like, also can slip and fall off during these activities. This can lead to frustration by the wearers at having to repeatedly replace or readjust the headwear, use smaller headwear or tighten the headwear to a point where the headwear may cause discomfort, or completely discard the headwear, in order to continue participation in these activities.

Various mechanisms attempting to improve the fit of articles of headwear have been previously described. For example, U.S. Pat. No. 6,895,601 to Park discloses headwear having a crown portion and a headband attached to and extending around the lower inside edge of the crown portion. The headband is disclosed as being preferably made of stretchable material and includes a layer of spongy material. The sewing thread used on the headband includes rubber thread and nylon stretch thread sewn together in a chain-like pattern to provide expandability and thereby increase the number of different wearer head sizes that may be accommodated by the headband. With this construction, a wide range of automatic size adjustment is obtained without imposing undue elastic pressure on the wearer. While the headbands expand to fit the head of the wearer, Park discloses in a preferred embodiment that the outer thread that comes into contact with the wearer's skin and/or hair is a nylon stretch thread, and that the inner thread is a rubber thread. Park further teaches that the best results are obtained with the nylon stretch outer thread and the rubber inner thread in accordance with the preferred embodiment.

Various mechanisms attempting to prevent perspiration from wearers' foreheads from dropping into the wearers' eyes during physical exertion have also been previously described. For example, U.S. Pat. No. 6,567,991 to Holslag et al. discloses a perspiration control device that includes a headband having opposite outer and inner sides and opposite front and back portions. The perspiration control device also includes at least one elongated seal strip applied on the inner side of the front portion of the headband and having opposite ends such that the seal strip will cross a forehead of a user when the headband is worn by the user. The seal strip will function to direct perspiration toward the opposite ends of the strip and thus toward opposite sides of the forehead and beyond the eyes of the user. When properly worn, a water tight seal is formed between the wearer's forehead and the headband, and any perspiration or sweat that forms on the forehead of the wearer is directed to move left and/or right past the opposite ends of the seal strip and beyond or away from the eyes toward the temples.

SUMMARY OF THE INVENTION

In one aspect, the invention is directed to an article of headwear including a body having an inner surface and sized to be disposed on the head of a wearer of the article of headwear, a headband disposed on the inner surface of the body and positioned to engage the head of the wearer of the article of headwear, and a friction thread attached to the headband such that at least a portion of the friction thread is exposed beyond a surface of the headband and engages the head of the wearer of the article of headwear, with the friction thread having a coefficient of friction greater than a coefficient of friction of the material of the headband.

In another aspect, the invention is directed to an article of headwear including a piece of fabric dimensioned to encircle the head of a person wearing the article, and a friction thread attached the piece of fabric such that at least a portion of the friction thread is exposed beyond a surface of the piece of fabric and engages the head of the wearer of the article of headwear, with the friction thread having a coefficient of friction greater than a coefficient of friction of the material of the piece of fabric.

In a further aspect, the invention is directed to an article of headwear including an elongated piece of fabric dimensioned to encircle the head of a person wearing the article and having oppositely disposed ends that are connected to form a continuous loop of fabric having a front edge and a rear edge. The article of headwear further includes a front gripping member attached to the elongated piece of fabric along the front edge of the continuous loop of fabric, with at least a portion of the front gripping member having a coefficient of friction greater than a coefficient of friction of the material of the elongated piece of fabric.

Additional aspects of the invention are defined by the claims of this patent.

BRIEF DESCRIPTION OF THE DRAWINGS

Objects, features, and advantages of the present device will become apparent upon reading the following description in conjunction with the drawing figures, in which.

Figure 1:
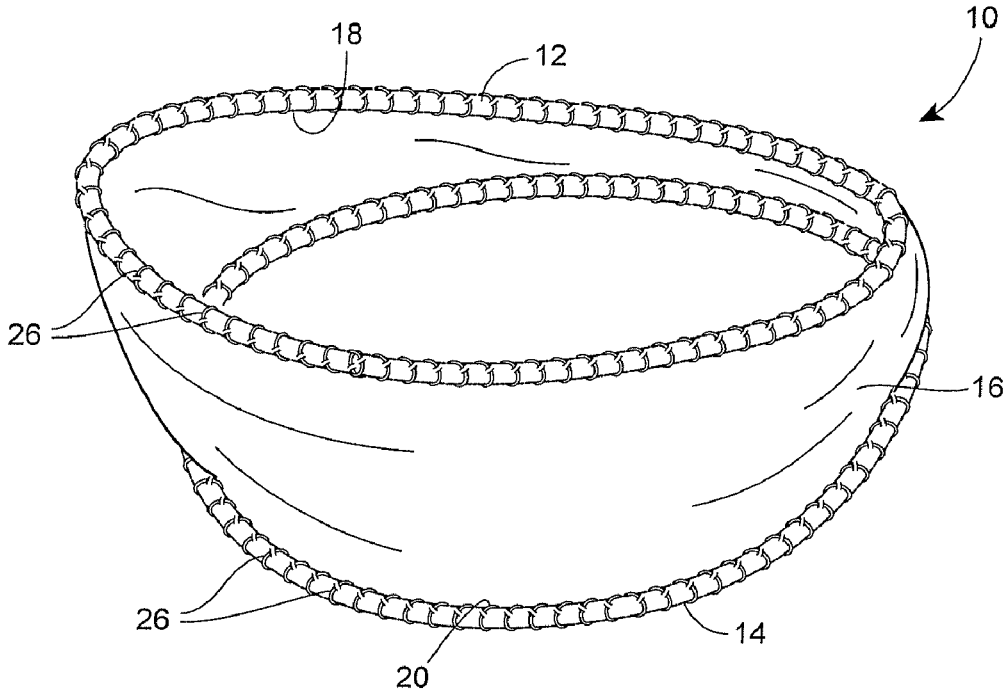
FIG. 1 is a perspective view of a head wrap having integrated gripping members in accordance with the present disclosure on both edges of the fabric loop.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure.

DETAILED DESCRIPTION OF THE DISCLOSURE

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

In order to address consumer frustration with headwear falling off of the head, a gripping member or feature can be added to various existing styles of headwear to more firmly secure the headwear on the wearers' heads during physical activities. The gripping member can be achieved on fabric headwear by weaving a strand of rubber or other gripping fiber into the fiber of the portion of the headwear that grips the head. The gripping member can be applied during an initial manufacturing step such that the gripping fibers are woven into the portion of the headwear gripping the head, such as the headband or portion of the fabric of the headwear touching the skin and/or hair, or may be added in as an additional component of the headwear during a separate manufacturing operation.

The following are some examples of the application of gripping members to existing headwear to prevent the headwear from sliding off of the wearers' heads. However, the embodiments shown herein are exemplary. Those skilled in the art will understand that gripping members incorporating gripping fibers may be applied to other headwear items, either integrally during the primary manufacturing process or separately during an additional manufacturing operation, to more firmly retain the headwear items on the wearers' beads, and such additional implementations are contemplated by the inventors. In addition, reflectivity, breathability, dry wicking, water proofing and the like may be applied to the headwear and/or gripping member to create added benefits for the wearers during physical activities.

Figure 2:
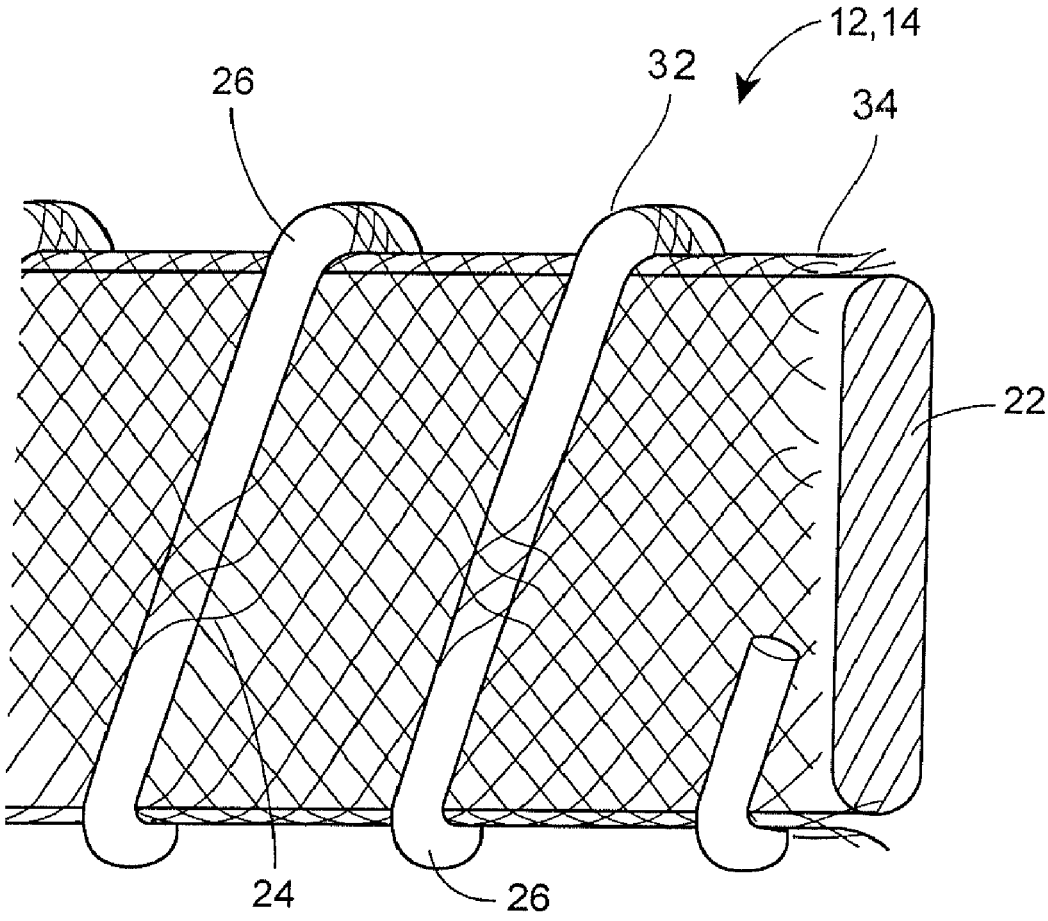
FIG. 2 is an enlarge view of a portion of an embodiment of a gripping member that may be implemented in the head wrap of FIG. 1.

FIG. 1 illustrates one embodiment of a head wrap 10 incorporating gripping members 12, 14 to improve the retention of the head wrap 10 when worn during physical activities. The head wrap 10 may be formed as a single loop from a piece of fabric 16, and with the gripping members 12, 14 being attached to the front and rear edges 18, 20, respectively, of the fabric loop 16 of the head wrap 10. The gripping members 12, 14 may be fabricated from elastic materials such that the gripping members 12, 14 may stretch to conform to the wearer's head. In one embodiment, the gripping member 12, 14 may be an elastic band such as that disclosed in U.S. patent application Ser. No. 11/272,996, filed on Nov. 14, 2005 (now U.S. Pat. No. 7,305,996 issued Dec. 11, 2007) and entitled "Elastic Band," the entire disclosure of which is incorporated herein by reference. Referring to FIG. 2, gripping members 12, 14 in the form of elastic band 12, 14 as taught in the referenced application may include an elastic core 22 surrounded by and substantially enclosed by a sheath 24. The sheath 24 further includes a friction member 26 in the form of, for example, a rubber thread that may be part of the sheath 24 or is simply threaded therethrough.

Figure 3:
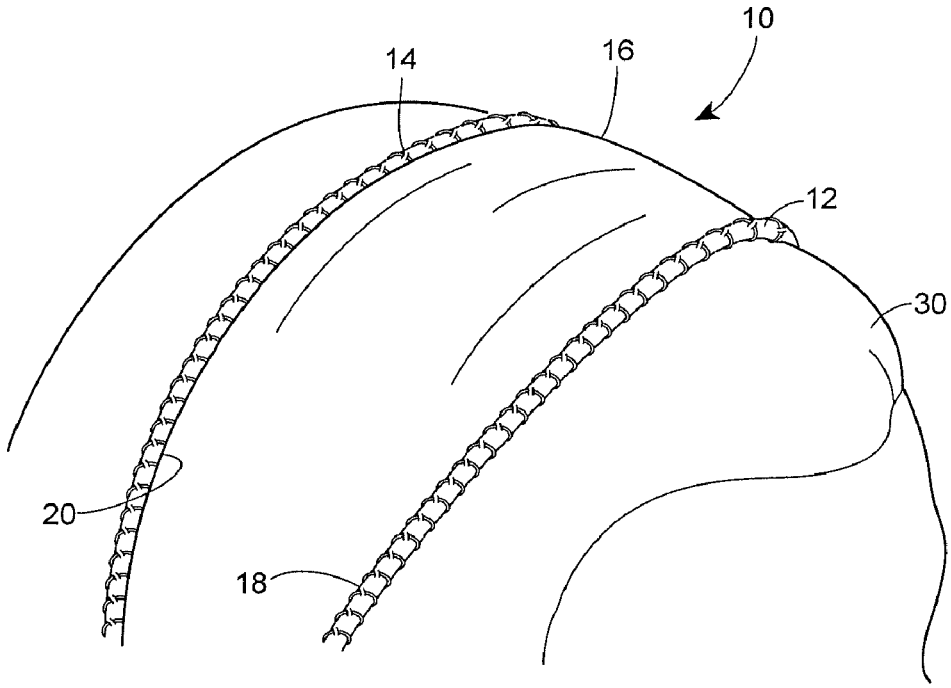
FIG. 3 is a perspective view of the head wrap of FIG. 1 disposed on the head of a wearer.

After the head wrap 10 is fabricated, the gripping members 12, 14 may be sewn onto the front and rear edges 18, 20, respectively, of the head wrap 10, and may be sized to conform to the sizes of the head wrap 10 and the heads 30 of the wearers to which the head wrap 10 will be sold (See FIG. 3). The rubber or other frictional threads 26 forming the gripping component of the gripping members 12, 14 may be wrapped in a helical pattern around the elastic band as shown in FIGS. 1 and 2, or may be implemented with any other desired pattern that conforms to the style of the head wrap 10 and provides the desired amount of additional grip strength when worn. Still further, the gripping members 12, 14 may be formed as a more integral component of the head wrap 10 by using the fabric 16 at the edges 18, 20 of the head wrap 10 as the sheath 24 of the elastic band 12, 14 wrapped around the core 22 and in which the gripping thread 26 is woven.

The core 22 may be elongate and constructed from an elastic material, such rubber, plastic, natural rubber, silicone, or other elastic or visco elastic materials. The sheath 24 may be elongate and constructed from a material, including but not limited to, plastic, paper, cloth, and elastic or visco elastic materials, but could be any material that does not have excessive adhesion to the strands of hair. The sheath 24 may be a woven material, but may be constructed from a non-woven material as well, and may be constructed such that the sheath can expand with the core 22 when the gripping member 12, 14 is stretched. The sheath 24 may be woven in a criss-cross pattern with the friction member 26 threaded or woven through the sheath. The friction member 26 may, in this exemplary embodiment, be part of the weave thereby replacing one or more of the threads or bunches of threads of the weave, as seen in FIG. 2, or may be an addition to the weave, such that the friction member is simply disposed between the previously woven sheath 24. The friction member 26 may be disposed at a surface of the sheath 24 such that additional threads or bundles of threads may be woven around the friction member 26 with portions of the friction member exposed through an exterior of the sheath to the hair. The friction member 26 may be constructed from a material that preferably has a higher friction coefficient that the material of which the sheath 24 is constructed. The friction member 26 may be constructed from material, including but not limited, to plastic, rubber, natural rubber, silicone, or other elastic or visco elastic materials. The friction member 26 may be woven into the sheath 24, as seen in FIG. 2, such that the friction member becomes part of the woven sheath. In one exemplary embodiment, an outer surface 32 of the friction member 26 may extend outwardly from an outer surface 34 of the sheath 24 such that the friction member 26 may contact the hair. Additionally, the outer surface 32 of the friction member 26 may abut the core 22, as seen in FIG. 2. As such, a cross-sectional area of the friction member 26 may be larger, or substantially larger, than a cross-sectional area of the material of which the woven sheath 24 is constructed, thereby ensuring that at least a part of the friction member contacts the hair.

Figure 4:
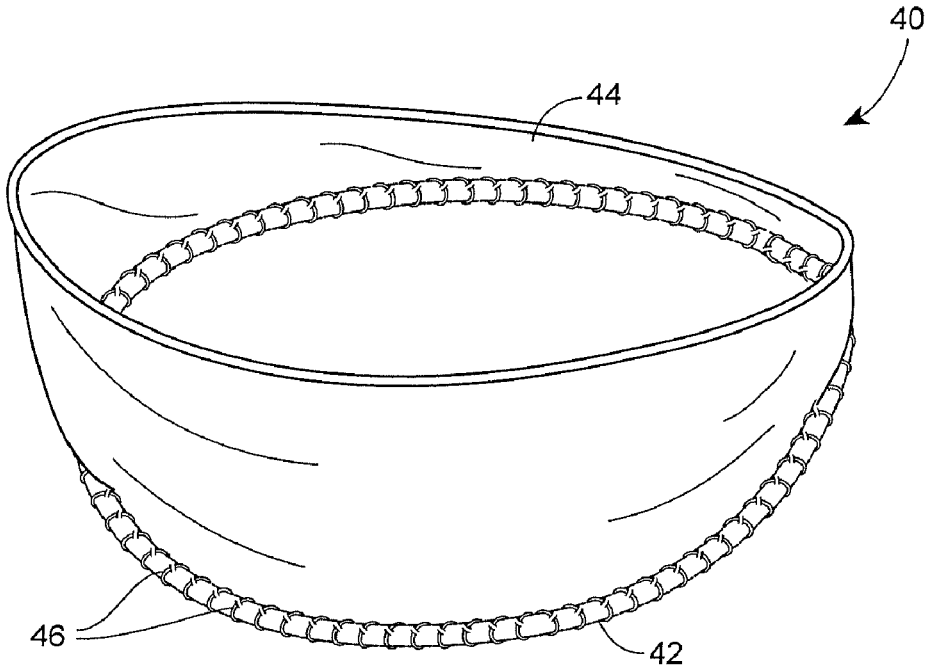
FIG. 4 is a perspective view of a head wrap having an integrated gripping member in accordance with the present disclosure on the front edge of the fabric loop.
Figure 5:
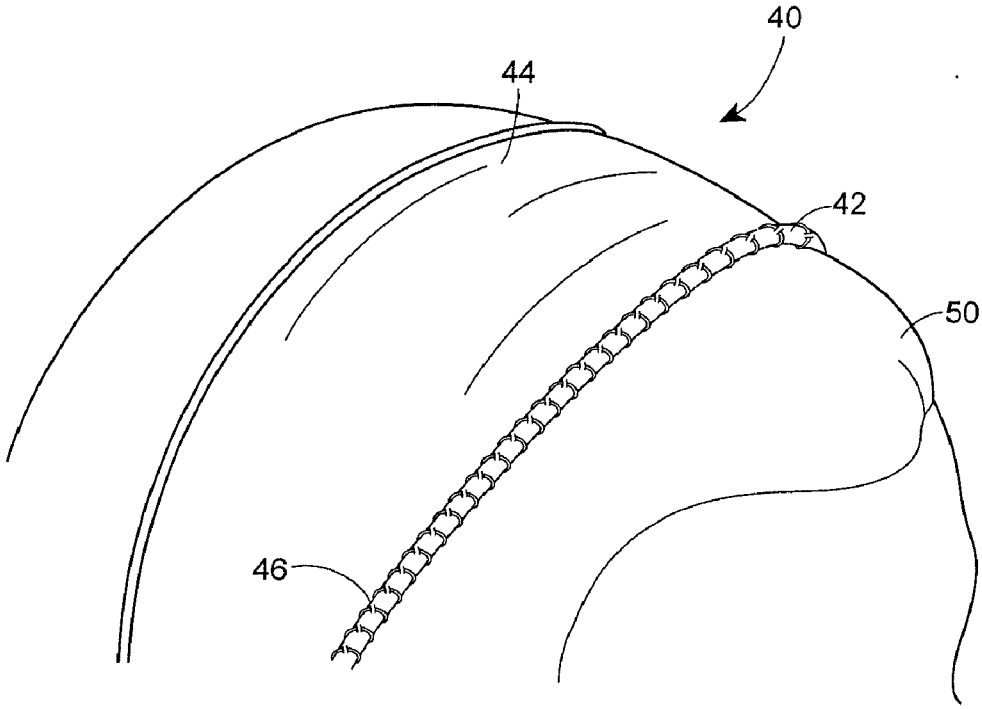
FIG. 5 is a perspective view of the head wrap of FIG. 4 disposed on the head of a wearer.

FIGS. 4 and 5 illustrate an alternative embodiment of a head wrap 40 wherein a gripping member 42 is attached to a fabric loop 44 of the head wrap 40 at a front edge 46 only. The single gripping member 42 may be similar to the elastic bands 12, 14 illustrated and discussed above, or may be any other appropriate configuration of an elastic band having gripping threads 26 for firmly attaching the head wrap 10 to the wearer's head 50 during physical activities.

Figure 6:
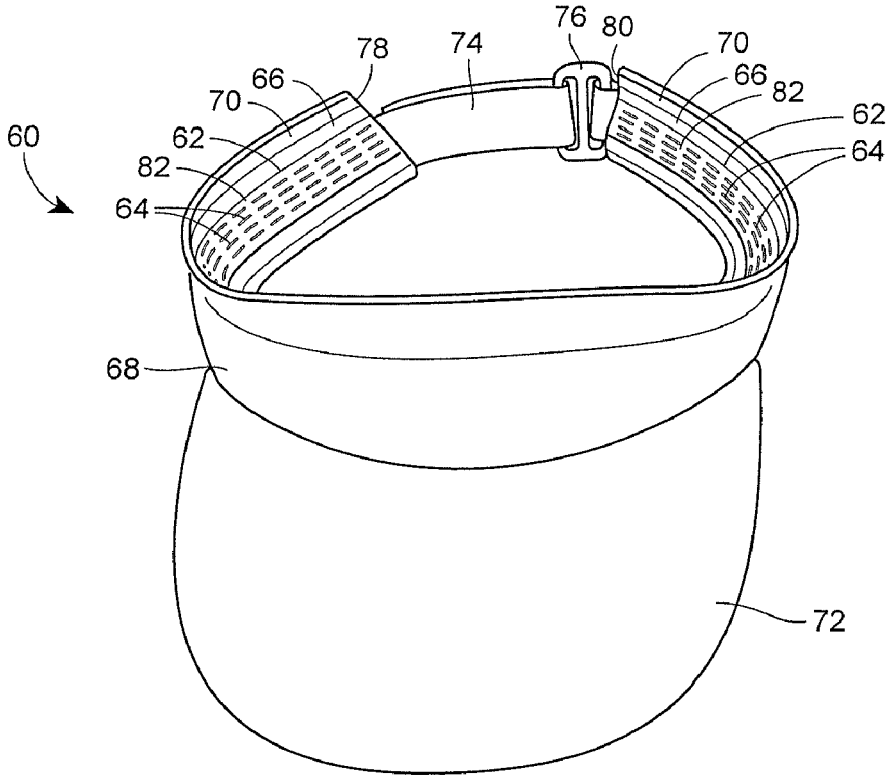
FIG. 6 is a perspective view from the top and front of a visor having an integrated gripping member in accordance with the present disclosure on the head band of the visor.
Figure 7:
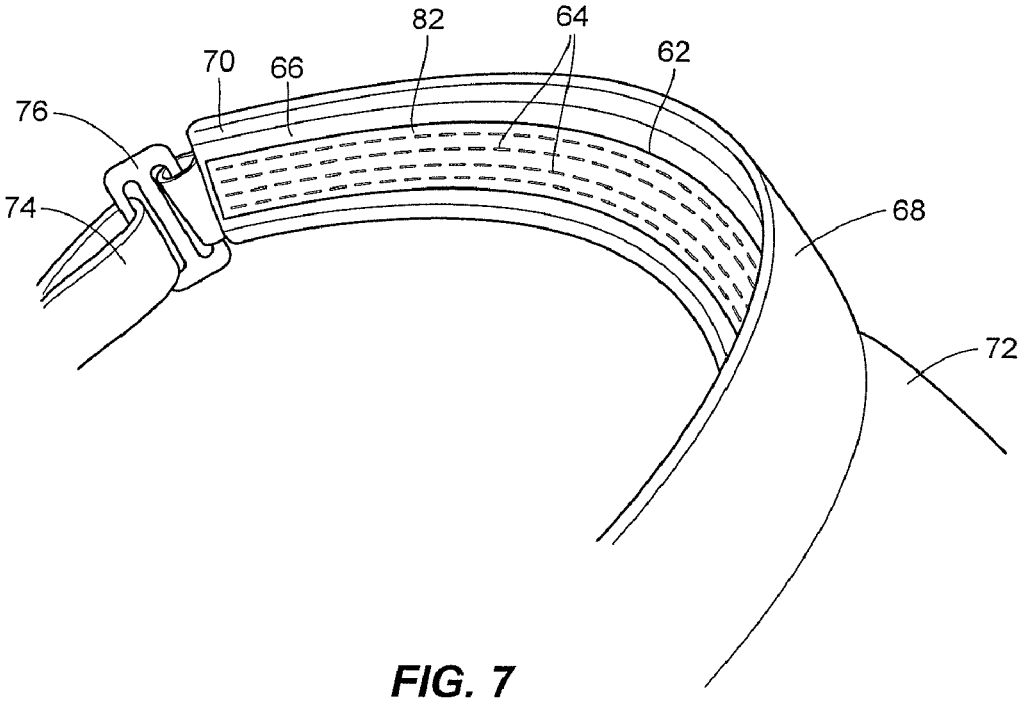
FIG. 7 is a perspective view from the top and right of the visor of FIG. 6.

FIGS. 6 and 7 illustrate an adjustable visor 60 in accordance with the present disclosure having a rubber tread gripping member 62 with interwoven gripping fibers 64 attached to a headband 66 of the visor 60. The visor 60 may be open at the top, and have a body sized to be disposed on the head of a wearer and including an upwardly extending crown 68 that encircles the head of the wearer with the headband 66 being disposed on an inner surface 70 thereof, and a bill 72 extending outwardly from a bottom edge of the crown 68 at front of the visor 60. At the rear of the visor 60, an adjustable strap mechanism having an adjustable strap 74 and a ring 76 connect to opposite ends 78, 80, respectively, of the crown 68 to complete a loop that will encircle the wearer's head and to allow adjustment for fitting varying head sizes. Such adjustment mechanisms are well known to those skilled in the art, and alternated adjustment mechanisms may easily be implemented in the visor 60 and are contemplated by the inventors as having use in headwear in accordance with the present invention.

The rubber tread gripping member 62 is fabricated by sewing rubber or other gripping threads 64 through a fabric strip 82 such that the threads 64 are interwoven in the strip 82 but at least partially project beyond the surface of the fabric strip 82 such that portions of the surfaces of the threads 64 engage the skin and/or hair of the wearer. The material for the threads 64, such as rubber, is selected such that the coefficient of friction of the material is greater than the coefficient of friction of the material from which the headband 66 and fabric strip 82 are fabricated, thereby increasing the retention of the visor 60 to the head of the wearer over that provided by a similar visor without the rubber tread gripping member 62. The sewing process may be continuous such that an extended web of the gripping member 62 may be fabricated, and strips of the gripping member 62 may be cut to size for each individual piece of headwear to which the gripping member 62 will be affixed. The strip or strips of the gripping member 62 may then be sewn to the headwear, such as on the headband 66 of the visor 60 illustrated above, in a position that allows the gripping threads 64 of the gripping member 62 to engage the skin and/or hair of the wearer. Alternatively, the gripping fibers may 64 be sewn directly into the headband 66 of the visor 60 or other article of headwear in a similar manner, thereby eliminating the need to attach a separate gripping member 62 to the headband 66.

Figure 8:
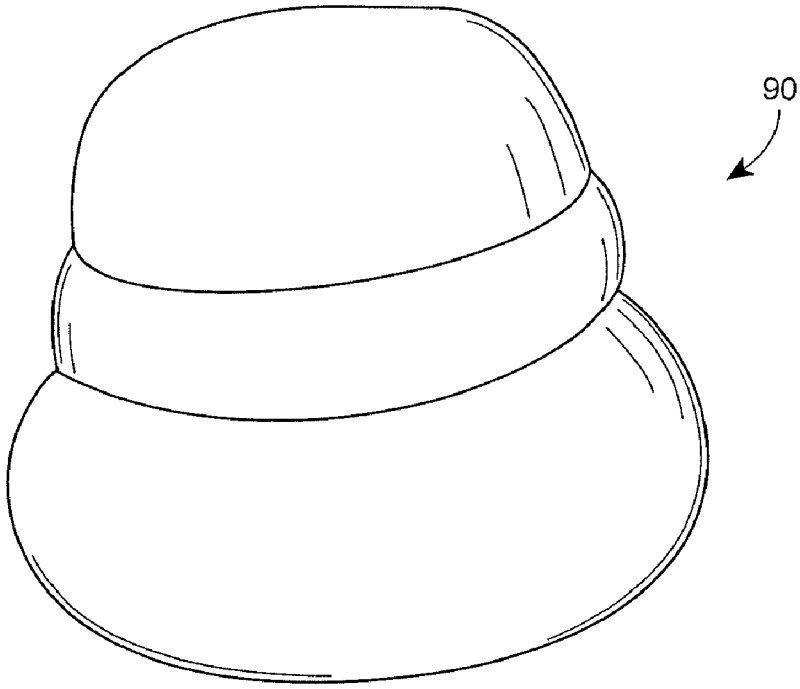
FIG. 8 is a perspective view from the top and front of a bucket hat that may have an integrated gripping member in accordance with the present disclosure on the head band of the bucket hat.
Figure 9:
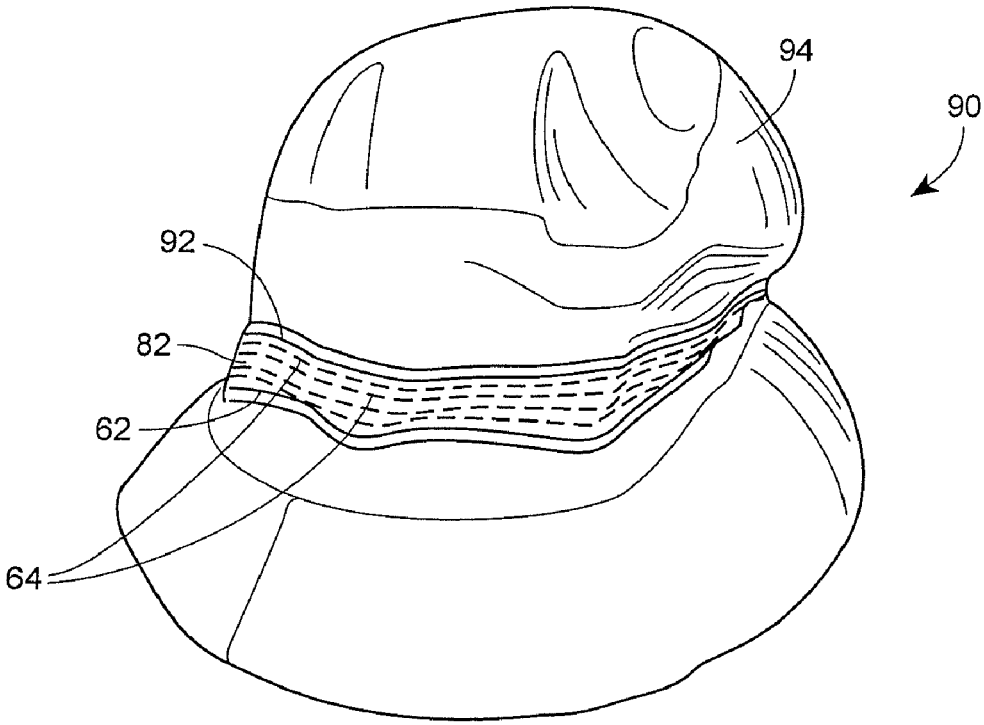
FIG. 9 is a perspective view from the top and front of bucket hat of FIG. 8 turned inside-out and having friction threads woven into the head band in accordance with the present disclosure.

FIGS. 8 and 9 illustrate the application of the rubber tread gripping member 62 to the inside of a bucket hat 90. The bucket hat 90 has a generally circular body and is closed at the top. With the bucket hat 90 turned inside-out as illustrated in FIG. 9, it is shown that a headband 92 is attached to an inner surface 94 of the bucket hat 90. The rubber tread gripping member 62 may be similar to that discussed above for the visor 60, and may consist of the separate fabric strip 82 having the gripping threads 64 woven therethrough and being attached to the headband 92 of the bucket hat 90 with the gripping threads 64 facing inwardly to engage the skin and/or hair of the person wearing the bucket hat 90. Alternatively, the gripping threads 64 may be woven directly into the headband 92 of the bucket hat 90 and at least partially projecting beyond the surface of the headband 92. Moreover, depending on the desired grip strength, the gripping member 62 or gripping threads 64 may be sewn or woven around the entire circumference of the headband 92 of the bucket hat 90, or may only be applied to a portion or potions of the inner circumference of the headband 92, such as with one gripping member 62 attached at the front of the bucket hat 90 and a second gripping member 62 attached at the rear of the bucket hat 90, or with a gripping member 62 extending around three-fourths of the circumference of the bucket hat 90 and not covering the rear portion of the headband 92.

Figure 10:
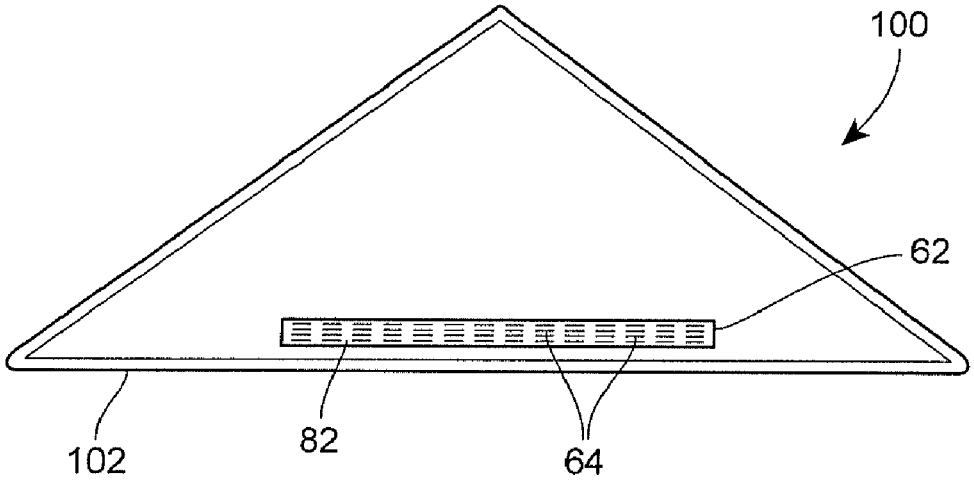
FIG. 10 is a top perspective view of a bandana having an integrated gripping member in accordance with the present disclosure.

FIG. 10 illustrates a triangular bandana 100 having a rubber tread gripping member 62 attached to the fabric 102 along the longest side 104 of the bandana 100 that is usually disposed about the wearer's forehead or against the hair above the forehead. As with the visor 40 and bucket hat 90, the gripping member 62 with the gripping threads 64 interwoven may be attached to the bandana 100, or the gripping threads 62 may be woven into the fabric 102 of the bandana 100 and, if desired, in a manner that complements or is integrated with the design of the bandana 100.

Figure 11:
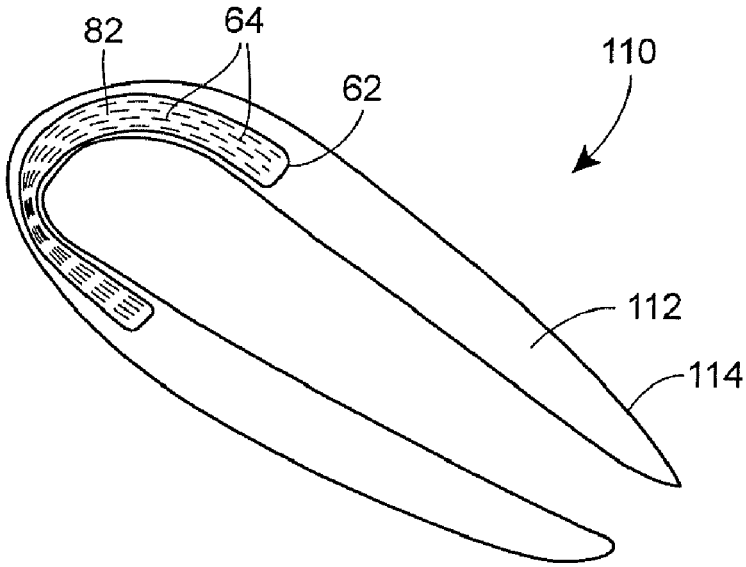
FIG. 11 is a bottom perspective view of a head tie having an integrated gripping member in accordance with the present disclosure.

FIG. 11 illustrates a head tie 10 having a rubber tread gripping member 62 attached to the inner surface 112 of the fabric 114 of the head tie 110. The gripping member 62 is positioned symmetrically about the front of the inner surface 112 of the head tie 110 so that the gripping threads 64 engage the wearer's forehead or the hair above the forehead. As with the other headwear 10, 40, 90, 100 discussed above, the gripping member 62 with the interwoven gripping threads 64 may be attached to the hair tie 110, or the gripping threads 64 may be woven into the fabric 114 of the hair tie 110. As with the bandana 100, the gripping threads 64 may be woven into the fabric 114 of the hair tie 110 in a manner that complements or is integrated with the design of the hair tie 110. Alternatively, if the bandana 100 or the hair tie 110 has multiple layers of fabric 102, 114, respectively, the gripping threads 64 may be woven into the inner layer(s) of fabric 102, 114 so that the gripping threads 64 are not visible from the outside when the bandana 100 or head tie 110 is worn.

While the preceding text sets forth a detailed description of numerous different embodiments of the invention, it should be understood that the legal scope of the invention is defined by the words of the claims set forth at the end of a subsequent patent claiming priority hereto. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fill within the scope of the claims defining the invention.

What is claimed is:

1. An article of headwear comprising:

an elongated piece of fabric dimensioned to encircle the head of a person wearing the article and having oppositely disposed ends that are connected to form a continuous loop of fabric having a front edge and a rear edge; and a front gripping member attached to the elongated piece of fabric along the front edge of the continuous loop of fabric, wherein the front gripping member comprises:

an elongated elastic core forming a continuous loop;

a sheath surrounding the elongated elastic core, the sheath haying an outer surface; and a friction thread disposed in the sheath, wherein at least a portion of the friction thread extends beyond the outer surface of the sheath, and wherein the friction thread has a coefficient of friction greater than a coefficient of friction of the material of the elongated piece of fabric.

2. An article of headwear in accordance with claim 1, comprising a rear gripping member attached to the elongated piece of fabric along the rear edge of the continuous loop of fabric, and wherein at least a portion of the rear gripping member has a coefficient of friction greater than a coefficient of friction of the material of the elongated piece of fabric.

3. An article of headwear in accordance with claim 1, wherein the friction thread is wrapped around the elastic core in a helical manner.

4. An article of headwear in accordance with claim 1, wherein the friction thread is woven into the sheath.

5. An article of headwear, comprising:

an elongated piece of fabric dimensioned to encircle the head of a person wearing the article and having oppositely disposed ends that are connected to form a continuous loop of fabric having a front edge and a rear edge; and a front gripping member attached to the elongated piece of fabric along the front edge of the continuous loop of fabric, wherein the first gripping member comprises:

an elongated elastic core forming a continuous loop;

a portion of the elongated piece of fabric proximate the front edge of the continuous loop of fabric, wherein the edge portion of the elongated piece of fabric is wrapped around the elongated elastic core, and wherein a surface of the edge portion of the elongated piece of fabric disposed on an opposite side from the elongated elastic core defines an outer surface of the first gripping member; and a friction thread disposed in the edge portion of the elongated piece of fabric, wherein at least a portion of the friction thread extends beyond the outer surface of the edge portion of the elongated piece of fabric, and wherein the friction thread has a coefficient of friction greater than a coefficient of friction of the material of the elongated piece of fabric.

6. An article of headwear in accordance with claim 5, wherein the friction thread is wrapped around the elastic core in a helical manner.

7. An article of headwear in accordance with claim 5, wherein the friction thread is woven into the edge portion of the elongated piece of fabric.

8. An article of headwear, comprising:

an elongated piece of fabric dimensioned to encircle a head of a person wearing the article and having oppositely disposed ends that are connected to form a continuous loop of fabric having a first edge and an opposite second edge; and a first gripping member attached to the elongated piece of fabric along the first edge of the continuous loop of fabric, wherein the first gripping member comprises:

an elongate elastic core comprising a continuous loop;

a sheath disposed at least partially around the elongate elastic core, the sheath having an outer surface facing outwardly away from the elongate elastic core; and an elongate friction member formed into the sheath and fabricated from a material having a greater coefficient of friction than the material from which the sheath is fabricated, wherein at least a portion of the elongate friction member is exposed through and protrudes outwardly beyond the outer surface of the sheath.

9. The elastic band of claim 8, wherein the elongate friction member is disposed around the core in a helical manner.

10. An article of headwear in accordance with claim 8, wherein the sheath is constructed from a woven fabric.

11. An article of headwear in accordance with claim 10, wherein the elongate friction member is woven into the sheath.

12. The elastic band of claim 8, wherein the core is constructed from at least one of a rubber, plastic, natural rubber, and silicone material.

13. The elastic band of claim 8, wherein the elongate friction member is constructed from at least one of a rubber, plastic, natural rubber, and silicone material.

14. An article of headwear in accordance with claim 8, wherein the sheath is made of a woven material, the friction member is made of an elastic material, and the elastic friction member is woven or threaded into the sheath.

15. An article of headwear in accordance with claim 14, wherein the sheath is woven of a plurality of threads and the friction member is woven or threaded into the woven sheath such that the friction member replaces one or more of the sheath threads and, together with the threads, forms the sheath.

16. An article of headwear in accordance with claim 14, wherein the sheath is woven of threads having a cross-sectional area and the friction member has a cross-sectional area that is larger than the cross-sectional area of the threads of the sheath.

17. An article of headwear in accordance with claim 14, wherein the friction member is woven into the sheath such that the friction member abuts the core.

18. An article of headwear in accordance with claim 8, wherein the coefficient of friction of the elongate friction member is greater than a coefficient of friction of the material of the elongated piece of fabric.

19. An article of headwear in accordance with claim 8, wherein the sheath is formed by a portion of the elongated piece of fabric proximate the first edge of the continuous loop of fabric, wherein the edge portion of the elongated piece of fabric is wrapped around the elongated elastic core.

* * * * *